US006791211B1

(12) United States Patent
Flegel

(10) Patent No.: US 6,791,211 B1
(45) Date of Patent: Sep. 14, 2004

(54) DOUBLE POLE CIRCUIT BREAKER AND SWITCH SYSTEM FOR A TRANSFER SWITCH

(75) Inventor: Michael O Flegel, Racine, WI (US)

(73) Assignee: Reliance Controls Corporation, Racine, WI (US)

( * ) Notice: Subject to any disclaimer, the term of this patent is extended or adjusted under 35 U.S.C. 154(b) by 387 days.

(21) Appl. No.: 09/939,192

(22) Filed: Aug. 24, 2001

(51) Int. Cl.[7] ..... H01H 19/64

(52) U.S. Cl. ..... 307/113; 307/85; 361/627; 361/636

(58) Field of Search ..... 307/85, 113, 125; 361/627, 634, 636

(56) References Cited

U.S. PATENT DOCUMENTS

| | | | |
|---|---|---|---|
| 5,761,027 | A | 6/1998 | Flegel |
| D400,183 | S | 10/1998 | Flegel |
| 5,895,981 | A | 4/1999 | Flegel |
| D425,490 | S | 5/2000 | Flegel |
| 6,066,817 | A | 5/2000 | Flegel |
| 6,107,701 | A | 8/2000 | Flegel |
| 6,163,449 | A | 12/2000 | Flegel |
| 6,184,461 | B1 | 2/2001 | Flegel |
| 6,293,821 | B1 | 9/2001 | Flegel |

*Primary Examiner*—Gregory J. Toatley, Jr.
(74) *Attorney, Agent, or Firm*—Boyle Fredrickson Newholm Stein & Gratz, S.C.

(57) ABSTRACT

A transfer switch for selectively connecting an auxiliary power source, such as a standby generator, to selected circuits of a building, includes double pole circuit protection as well as a unique circuit breaker and switch arrangement which can be used in either a double pole circuit or a pair of single pole circuits. The transfer switch includes a main double pole circuit breaker downstream of the power inlet, for providing double pole overcurrent protection for all circuits interconnected with the transfer switch. The transfer switch also includes a series of single pole switches and associated single pole circuit breakers, for controlling the supply of power to single pole electrical circuits. At least one additional pair of single pole switches can either be tied together for use as a double pole switch or used as two separate single pole switches. When the pair of switches are tied together for use as a double pole switch, a double pole connector member is employed in a circuit breaker mounting arrangement which is normally adapted to receive two single pole circuit breakers. Overcurrent protection is provided either by the main double pole circuit breaker, or by a branch double pole circuit breaker located between the main double pole circuit breaker and the pair of switches. When the switches are to be used separately, a pair of single pole circuit breakers are engaged with the circuit breaker mounting arrangement in place of the double pole connector member, to provide individual single pole circuit protection.

28 Claims, 7 Drawing Sheets

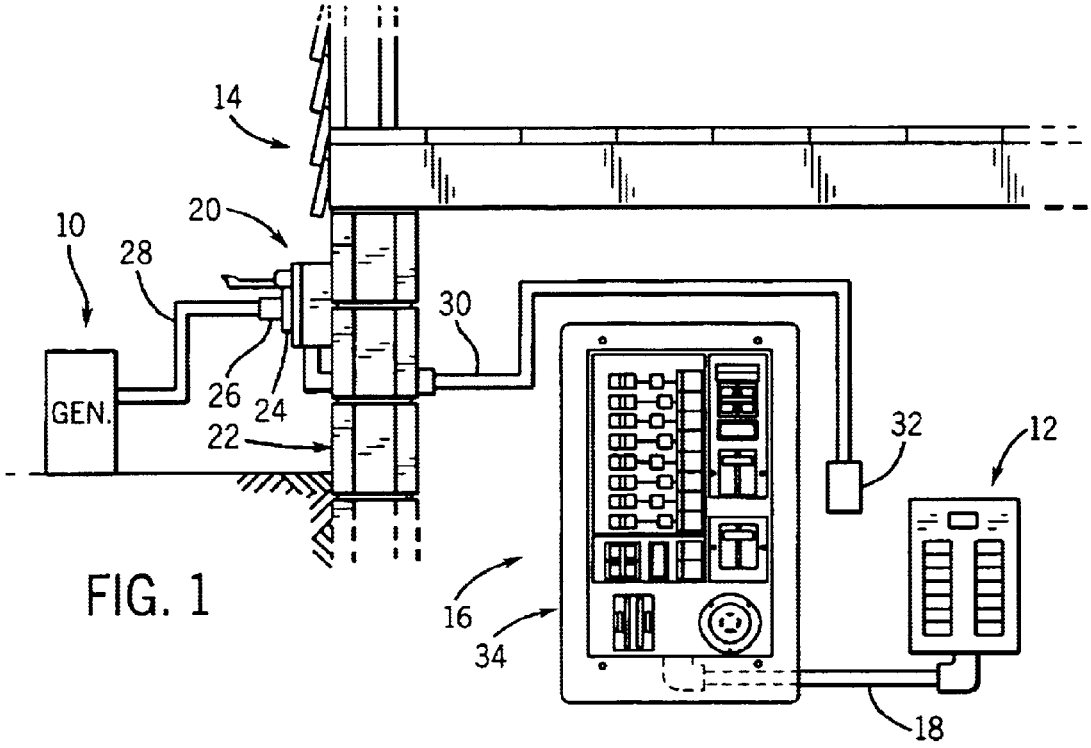
FIG. 1
FIG. 1a
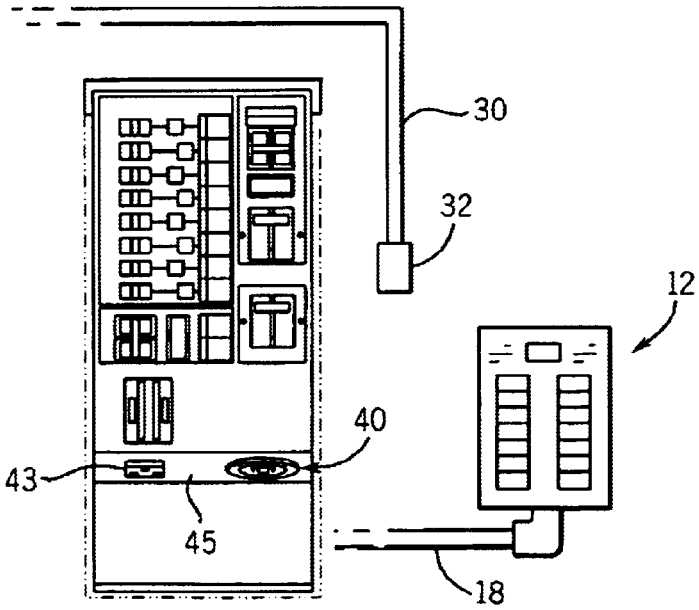

DOUBLE POLE CIRCUIT BREAKER AND SWITCH SYSTEM FOR A TRANSFER SWITCH

BACKGROUND AND SUMMARY OF THE INVENTION

This invention relates to a transfer switch for providing power to the electrical system of a building, such as power supply from a standby generator.

Transfer switches are commonly employed to feed electrical power to selected circuits of a building electrical system during a utility power outage. A transfer switch typically includes a power inlet which is adapted to be electrically interconnected with a power feed from the generator, which supplies power to the transfer switch upon operation of the generator. The transfer switch further includes individual circuit switches which are interconnected with the power inlet and with selected circuits of the building electrical system. During normal operation when power is supplied by a utility or other primary power source, the selector switches are positioned to complete the electrical circuit between the utility power supply and the circuits of the building electrical system. When the primary power supply is discontinued such as during a power outage, or when it is otherwise desired to power selected circuits from an auxiliary power source such as a standby generator, the selector switches are positioned to interrupt the primary power supply circuit and to complete a power supply circuit which includes the auxiliary power source. This functions to supply power to the selected circuits from the auxiliary power source.

The assignee of the present application has developed a number of transfer switch improvements, such as are disclosed in U.S. Pat. No. 5,895,981 issued Apr. 20, 1999 entitled "Generator Transfer Panel With A Terminal Arrangement For Establishing A Direct Connection To A Remote Power Inlet"; U.S. Pat. No. 6,163,449 issued Dec. 19, 2000 entitled "Transfer Switch With Optional Power Inlet And Meter Panel"; copending application Ser. No. 09/062,257 filed Apr. 17, 1998 (now U.S. Pat. No. 6,293,821 issued Sep. 25, 2001) entitled "Optional plug Connector For A Transfer Switch Having A Terminal Component"; U.S. Pat. No. 6,107,701 issued Aug. 22, 2000 entitled "Optional Meter Panel For A Transfer Switch Having A Terminal Compartment"; U.S. Pat. No. 6,066,817 issued May 23, 2000 entitled "Socket-Type Circuit Breaker Mounting System"; and copending application Ser. No. 09/692,020 filed Oct. 19, 2000 entitled "Transfer Switch With Selectively Configurable Cover Structure With Power Input And Meter Capability Separate Power Input And Meter Panels", the disclosures of which are hereby incorporated by reference.

Prior art transfer switches typically utilize single pole double throw selector switches which are acceptable for interconnection in single pole type building electrical circuits. However, there are certain building electrical circuits, such as those associated with a hot water heater or a well pump, which are of a double pole type. In the past, it has been known to tie together a pair of single pole switches for use in switching power in a double pole circuit. This functions to satisfactorily transfer auxiliary power in a double pole circuit.

Prior art transfer switches typically have overcurrent circuit protection in the form of a single pole type circuit breaker interconnected with each single pole selector switch. This arrangement functions satisfactorily to provide circuit protection in single pole type circuits. However, while two interconnected single pole switches function to create a satisfactory double pole switching arrangement for use in a double pole circuit, the overcurrent circuit protection provided by the single pole circuit breakers interconnected with the two single pole switches is a different type of circuit protection than is provided by a double pole circuit breaker.

In addition, prior art transfer switches typically have power supplied directly from the power inlet to the branch circuits, which incorporate single pole circuit breakers. At present, there is an uncertainty in electrical code interpretation as to whether a double pole circuit breaker is required for branch circuit protection.

It is an object of the present invention to provide a transfer switch with a number of enhancements in utility, convenience and circuit protection. Yet another object of the invention is to provide a transfer switch which has enhanced branch circuit protection downstream of the power inlet. Yet another object of the invention is to provide a transfer switch capable of interconnection in double pole branch circuits which includes double pole branch circuit protection. A still further object of the invention is to provide such a transfer switch having circuit connections which can easily be modified for use in either a double pole circuit or a pair of single pole circuits, while providing a compatible type of circuit protection in either case. A still further object of the invention is to provide such a transfer switch which can be modified relatively quickly and easily to provide a double pole switch and circuit breaker arrangement. Yet another object of the invention is to provide such a transfer switch which has a construction and operation generally similar to prior art transfer switches but which incorporates features enhancing use in connection with one or more double pole circuits and which eliminates any uncertainty with requirements pertaining to branch circuit protection.

In accordance with the invention, a transfer switch is adapted for connection between an auxiliary power supply, such as a standby generator, and an electrical load center associated with a building electrical system having a series of electrical circuits. The building electrical circuits include both single pole circuits and double pole circuits. The transfer switch includes a power inlet for supplying power to the transfer switch from the auxiliary power source, typically in the event of a primary power source outage such as a utility power interruption. The transfer switch includes a series of single pole switches and single pole circuit breakers, which are adapted for connection with single pole circuits in the building electrical system.

The transfer switch includes a double pole main circuit breaker connected downstream of the power inlet. The double pole main circuit breaker provides double pole circuit protection for all branch circuits interconnected with the transfer switch.

The transfer switch includes at least one pair of single pole switches which are adapted to be connected together to provide a double pole switch configuration, and a double pole circuit breaker is adapted to be connected in line with the double pole switch formed by the interconnected single pole switches. In one form, the double pole circuit protection is provided by a main circuit breaker connected downstream of the power inlet which provides double pole circuit protection for all single pole branch circuits as well as any double pole branch circuits. In an alternative arrangement, a separate dedicated double pole circuit breaker may be connected in line with an individual double pole branch circuit which is controlled via two single pole switches which are connected together to form a double pole switch, to provide dedicated double pole circuit protection for a double pole circuit.

In either case, double pole circuit protection is provided upstream of the pair of single pole switches which are interconnected to form the double pole switch. The pair of single pole switches can also be used separately in single pole circuit applications, and include single pole circuit breakers which are typically mounted in a socket-type mounting arrangement. When the pair of single pole switches are connected together to form a double pole switch, a double pole circuit breaker is connected in line with the interconnected single pole switches such that the single pole circuit breakers are no longer required. In this case, a conductor member is engaged with the socket-type mounting arrangement for the two single pole circuit breakers, to establish an electrical path between the double pole circuit breaker and the pair of switches which are connected together to form the double pole switch. In a preferred form, the socket-type mounting arrangement defines a pair of aligned side-by-side sockets, each of which is connected in line with one of the switches and is capable of receiving a single pole circuit breaker. The conductor member is configured to fit into the pair of sockets defined by the socket-type mounting arrangement, and includes a pair of separate conductors which engage the socket connections to complete the electrical path between the double pole circuit breaker and the pair of switches. The remaining single pole circuit breakers of the transfer switch are also mounted via a socket-type circuit breaker mounting arrangement, which includes sockets that are arranged in a manner which is incompatible with the conductor member. In this manner, the conductor member can only be used in connection with the specific mounting arrangement associated with the specific pair of switches which are interconnected together to form a double pole switch and which are used in combination with a double pole circuit breaker.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is a schematic representation showing a transfer switch constructed according to the present invention, for interconnecting an auxiliary power source with selected circuits of an electrical load center associated with a building;

FIG. 1A is a view similar to FIG. 1, showing an alternative configuration for the transfer switch of FIG. 1;

DETAILED DESCRIPTION OF THE INVENTION

Figure 2:
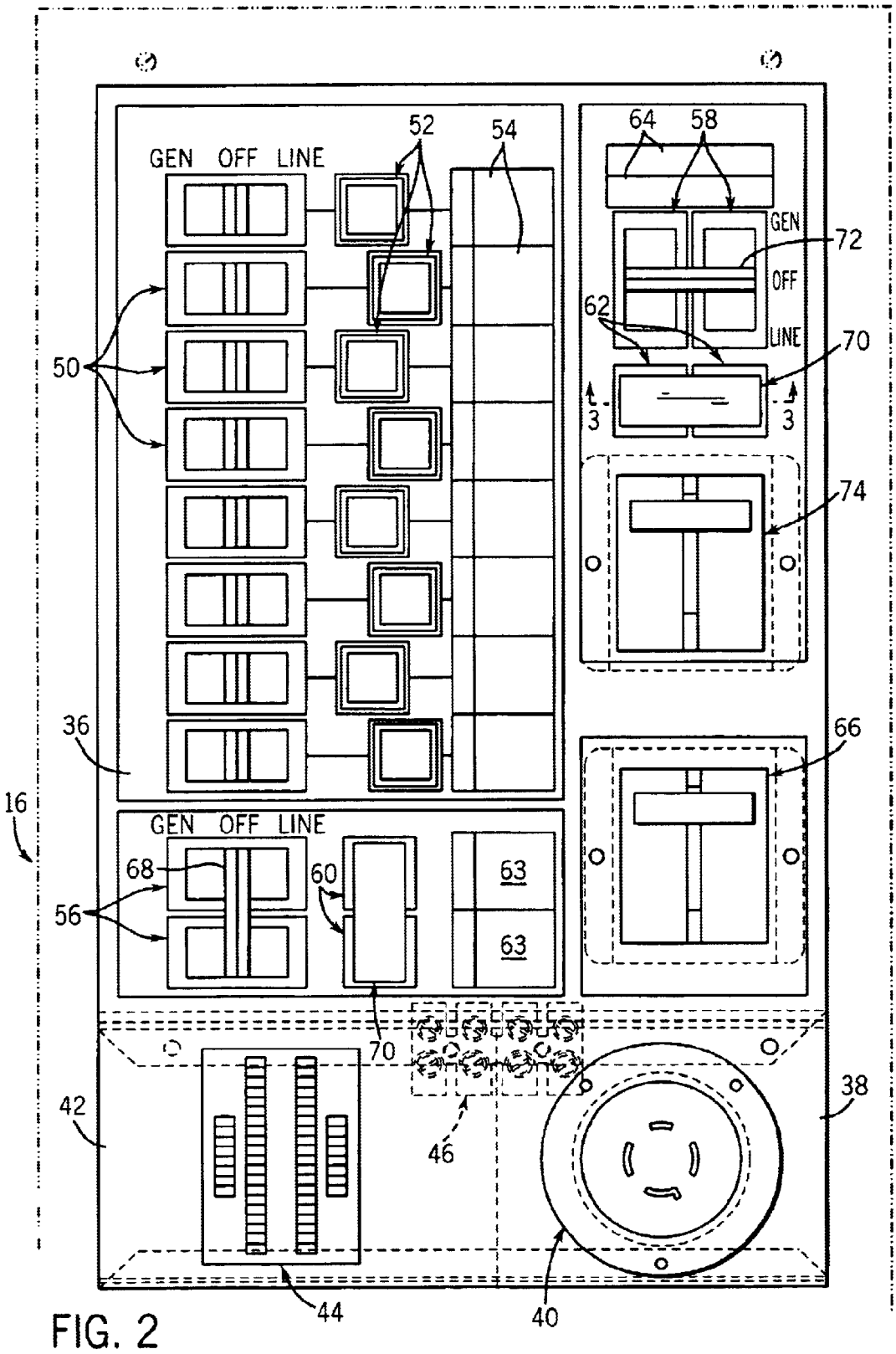
FIG. 2 is an elevation view showing the components incorporated into the transfer switch of the invention, such as is illustrated in FIGS. 1 and 1A.

FIG. 1 illustrates a portable generator 10 which is adapted to supply auxiliary power to a main electrical panel or load center, shown schematically and not to scale at 12, located in the interior of a building 14. In a known manner, main electrical panel 12 is connected to a primary power source, such as utility power, and connects the primary power source to the various electrical circuits of building 14. A manual power transfer switch 16 constructed according to the invention is mounted adjacent main electrical panel 12, and is interconnected therewith via a series of wires enclosed by a conduit 18 extending between main panel 12 and transfer switch 16.

A power inlet box 20 is mounted to the wall of building 14, shown at 22. Power inlet box 20 includes a receptacle 24 which is adapted to receive a plug 26 connected to the end of a power supply cord 28 extending from generator 10. In a known manner, receptacle 24 is interconnected with a series of wires located within a cable 30 disposed within the interior of building 14. A plug 32 is mounted to the end of cable 30, and is selectively engageable with transfer switch 16 for supplying power to transfer switch 16 from generator 10. Cable 30 may be mounted directly to the inside of wall 22 as shown, or may extend from a junction box mounted inside building 14 which is interconnected with receptacle 24 via a series of wires enclosed within a conduit or the like, in a known manner. Alternatively, receptacle 24 may be wired directly to the power inlet of transfer switch 16, in a manner as is disclosed in U.S. Pat. No. 5,895,981 and as will later be explained.

As shown in FIGS. 1 and 2, transfer switch 16 generally includes a flush mount housing 34 with a front wall 36. Housing 34 further includes a power input panel 38 having a power input socket 40 mounted thereto, and a meter panel 42 having a power input meter 44 mounted thereto. Power input panel 38 and meter panel 42 are separate from each other, and are generally constructed and arranged as shown and described in the above-noted copending application Ser. No. 09/692,020 filed Oct. 19, 2000. While power input meter 44 is illustrated as a digital meter having a series of LEDs for providing a visual indication of power supplied to transfer switch 16, it is understood that a conventional analog-type meter arrangement may be employed in place of digital meter 44.

FIG. 1A shows an alternative surface mount transfer switch arrangement, in which power input socket 40 and an outlet receptacle 43 are mounted to a downwardly facing panel 45. In all other substantive respects, the transfer switch of FIG. 1A is identical to transfer switch 16 as will be described.

In a known manner, plug 32 at the end of cable 30 is engageable with power input socket 40 so as to supply power to transfer switch 16 from generator 10. A terminal assembly 46 is located within a terminal compartment enclosed by power input panel 38 and meter panel 42. In a known manner, wires from power input socket 40 are connected to selected terminals of terminal assembly 46, to supply power to the components of transfer switch 16 when plug 32 is engaged with socket 40. In an alternative version as noted previously, power input wires can be connected directly between power inlet box 20 and terminal assembly 46, so as to supply power to transfer switch 16 without the need to engage plug 32 with power input sockets 40.

Transfer switch 16 includes a series of conventional single pole double throw selector switches 50 mounted to front wall 36. A socket-type circuit breaker mounting member 52 is connected to each selector switch 50, and is adapted to receive a conventional single pole circuit breaker (not shown). Socket-type circuit breaker mounting members 52 are constructed and connected as shown and described in the above-noted U.S. Pat. No. 6,066,817. Adjacent circuit breaker mounting members 52 are arranged in a staggered offset relationship, the purpose of which will later be explained. A circuit description area 54 is located in line with each selector switch 50 and circuit breaker mounting member 52, for receiving indicia identifying the circuits of the building electrical system in which switches 50 and mounting members 52 are connected. For each such circuit, switches 50 are movable between three different positions. A first position of switch 50 connects the circuit to the power supply from generator 10, a second position connects the circuit to the power supply from a primary source, such as utility power, and a third position is an OFF position which cuts off the power supply to the circuit.

In addition, a first pair of additional single pole switches 56 and a second pair of additional single pole switches 58 are mounted to front wall 36. Each of a first pair of additional circuit breaker mounting members 60 is connected to one of switches 56, and each of a second pair of circuit breaker mounting members 62 is connected to one of switches 58. Switches 56 and 58 are single pole double throw switches like switches 50, and circuit breaker mounting members 60 and 62 are of the same construction as circuit breaker mounting members 52.

Circuit description areas 63 are located adjacent circuit breaker mounting members 60 and circuit description areas 64 are located adjacent switches 58, for receiving indicia identifying the circuits of the building electrical system in which switches 56 and 58, respectively, are connected.

Transfer switch 16 further includes a main double pole circuit breaker 66 mounted to front wall 36. Main circuit breaker 66 is interconnected downstream of power input socket 40, and may be a double pole circuit breaker such as is available from Siemens of Alpharetta, Ga. under its Part No. Q220, Q230 or Q250, although it is understood that other satisfactory double pole circuit breakers may be employed.

In the embodiment illustrated in FIG. 2, single pole switches 56 are connected together in unison to form a double pole switch. Each switch 56 includes a conventional manually operated switch handle, and the handles of switches 56 are connected together to move in unison by means of a connector bar 68. The double pole switch formed by connected switches 56 is adapted for connection in a double pole circuit from main panel 12. Double pole circuit protection is provided by main circuit breaker 66, and individual single pole circuit breakers are not required in addition to double pole circuit breaker 66. In this case, a double pole connector member, shown generally at 70, is engaged with circuit breaker mounting members 60.

In a similar manner, single pole switches 58 are connected together via a switch handle connector bar 72, to form a double pole switch adapted for connection in a double pole circuit from main panel 12. A branch double pole circuit breaker 74 is connected between main double pole circuit breaker 66 and switches 58. Branch double pole circuit breaker 74 may be generally the same type of circuit breaker as main double pole circuit breaker 66. Again, individual single pole circuit protection is not required, and a double pole connector member 70 is engaged with circuit breaker mounting members 62.

Figure 3:
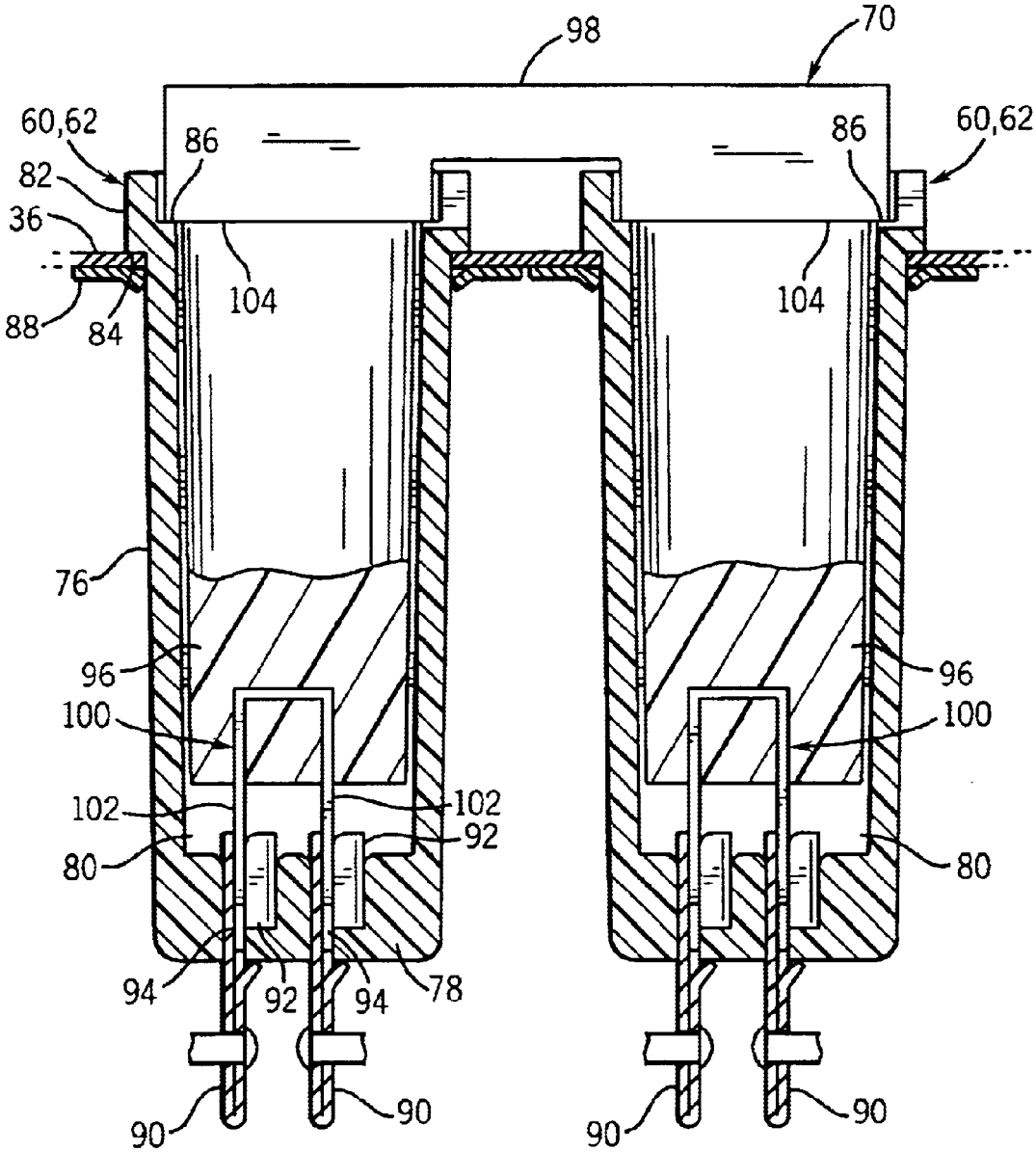
FIG. 3 is a partial section view taken along line 3—3 of FIG. 2.

FIG. 3 illustrates the construction of socket-type circuit breaker mounting members 52, 60 and 62, as well as double pole connector member 70. As noted previously, mounting members 52, 60 and 62 are constructed as shown and described in U.S. Pat. No. 6,066,817. Each circuit breaker mounting member is generally cylindrical, including a sidewall 76 and an end wall 78 which cooperate to define an outwardly opening internal cavity 80. Sidewall 76 terminates in an outer section 82 which defines an external shoulder 84 and an internal shoulder 86. The mounting member is inserted through an opening formed in front wall 36 such that external shoulder 84 engages the outer surface of front wall 36, with the remainder of the mounting member being disposed within the interior of housing 34. A mounting ring 88 is pushed onto the internal portion of the mounting member, and engages the outer surface of sidewall 76 for retaining the mounting member in engagement with front wall 36.

A pair of conductive prongs 90 extend through slots formed in end wall 78, extending outwardly therefrom. Engagement members 92 are received within recesses formed in end wall 78, and cooperate with the internal portions of prongs 90 to form a contact space 94 therebetween.

Double pole connector member 70 includes a pair of insert body members 96 which are connected together at their outer ends by an outer bridge member 98. In a preferred form, insert body members 96 and bridge member 98 are formed integrally with each other, although it is understood that these components may be formed separately and connected together in any satisfactory manner. Bridge member 98 is dimensioned such that insert body members 96 are spaced apart from each other a distance which corresponds to the spacing between circuit breaker mounting members 60 and circuit breaker mounting members 62.

An inverted U-shaped conductor member 100 is located at the inner end of each insert body member 96. Each conductor member 100 may be formed integrally with its respective insert body member 96, such as in an insert molding operation, although other satisfactory mounting methods may be employed. Each conductor member 100 includes a pair of contacts 102 which extend from the inner end of insert body member 96 and are spaced apart a distance corresponding to the spacing between contact spaces 94. With this construction, contacts 102 are adapted to be received within contact spaces 94, to provide electrical engagement of conductor member 100 with prongs 90.

Double pole connector member 70 is adapted to be engaged within mounting members 60, 62 such that insert body members 96 are received within internal cavities 80 as shown in FIG. 3. A downwardly facing shoulder 104 is formed at the interface between bridge member 98 and each insert body member 96, to engage internal shoulders 86. When double pole contact member 90 is engaged with mounting members 60, 62 in this manner, contacts 102 are engaged with prongs 90 as shown, such that each conductor member 100 establishes an electrical connection between its respective pair of prongs 90. In this manner, the double pole connector member 70 engaged with mounting members 60 establishes an electrical path between main double pole circuit breaker 66 and the double pole switch formed by interconnected single pole switches 56. Similarly, the double pole connector member 70 engaged within mounting members 62 functions to establish an electrical path between double pole branch circuit breaker 74 and the double pole switch formed by the interconnected single pole switches 58.

Figure 4:
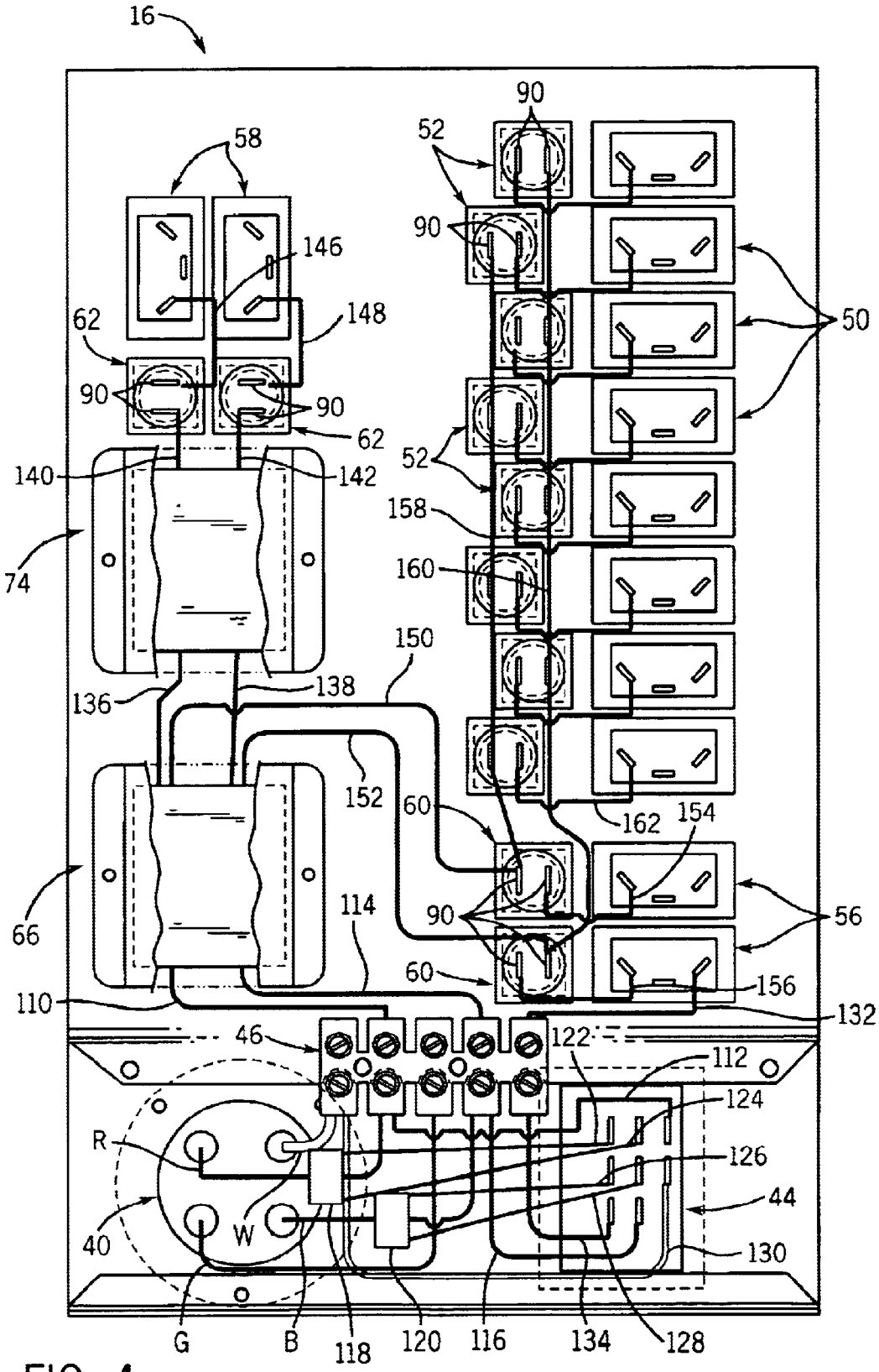
FIG. 4 is a rear elevation view illustrating connection of the transfer switch components illustrated in FIG. 2.

FIG. 4 illustrates the internal interconnections of the various components of transfer switch 16 illustrated in FIGS. 1–3. The connections of the various transfer switch components with main electrical panel 12 are identical to such connections as are known in the art, and are not illustrated.

As shown in FIG. 4, power input wires extend rearwardly from power input socket 40, and are shown at W, G, R and B. Wire W is interconnected with the neutral of main electrical panel 12 through terminal assembly 46, and wire G is interconnected with the frame of transfer switch 16 through terminal assembly 46. Wire R is connected to terminal assembly 46 and to main double pole circuit breaker 66 through a wire 110 which extends between terminal assembly 46 and main double pole circuit breaker 66. A branch wire 112 is connected to input wire R at terminal assembly 46, and is also interconnected with one of the prongs of power inlet meter 44. Similarly, input wire B is connected to terminal assembly 46 and to main double pole circuit breaker 66 through a wire 114. A branch wire 116 is interconnected with input wire B at terminal assembly 46, and is connected to one of the prongs of power input meter 44. Wires R and B extend through current transformers 118, 120, respectively, for connection to terminal assembly 46. Wires 122, 124 extend from current transformer 118 to selected prongs of power input meter 44, and wires 126, 128 extend from current transformer 120 to selected prongs of power input meter 44. In a manner as is shown, current transformers 118, 120 provide power input readings on input meter 44.

A neutral wire 96 is interconnected with neutral wire W at terminal assembly 46, and is connected to one of the prongs of power input meter 44. An input wire 132 is connected between terminal assembly 46 and the load side prong of one of switches 56, and is interconnected through terminal assembly 46 with an input wire 134 connected to one of the prongs of input meter 44, for providing a visual indication as to the presence of power from the primary power source.

Main double pole circuit breaker 66 functions to provide overcurrent protection to all of the circuits interconnected with transfer panel 16, by virtue of the connection of input wires 110, 114 from terminal assembly 46 to main double pole circuit breaker 66. A first pair of branch power supply wires 136, 138 supply power to branch double pole circuit breaker 74 from main double pole circuit breaker 66, which in turn is interconnected with prongs 90 of circuit breaker mounting members 62 through wires 140, 142. With connector member 70 engaged with mounting members 62 as shown in FIG. 3, power is transferred through conductors 100 to the opposite prongs 90 of mounting members 62, and through a pair of wires 144, 146 to the supply side prongs of single pole switches 58. Typically, main double pole circuit breaker 66 will have an amperage rating greater than that of branch double pole circuit breaker 74. Representatively, main circuit breaker 66 has an amperage rating of 30 amps and branch circuit breaker 74 has an amperage rating of 20 amps. In this manner, main double pole circuit breaker 66 provides 30 amp double pole circuit protection for all circuits downstream of power input socket 40. Branch double pole circuit breaker 74 provides a reduced overcurrent protection value for a double pole circuit, e.g. a well pump circuit.

An additional pair of branch power input wires 150, 152 extend from main double pole circuit breaker 66, and each is connected to one of prongs 90 associated with circuit breaker mounting members 60. With connector member 70 engaged with mounting members 60 as shown in FIG. 3, conductors 100 establish an electrical path to the opposite prong 90, which are interconnected with the supply side prongs of switches 56 through wires 154, 156, to supply power to switches 56. With this arrangement, main circuit breaker 66 provides circuit protection for a double pole circuit interconnected with the double pole switch defined by interconnected single pole switches 56, according to the rating of main double pole circuit breaker 66. Representatively, a high amperage load, such as a water heater, may be supplied with power through main double pole circuit breaker 66 and switches 56.

From circuit breaker mounting members 60, power is supplied to circuit breaker mounting members 52 through a pair of wires 158, 160, each of which is connected to one of prongs 90 of circuit breaker mounting members 60. Each individual circuit breaker mounting member 52 has a construction like that of circuit breaker mounting members 60, 62 illustrated in FIG. 3, including a pair of prongs 90. Wire 158 is connected to the supply side prong 90 of every other one of circuit breaker mounting members 52. Similarly, wire 160 is connected to the supply side prong of the remaining circuit breaker mounting members 52. With single pole circuit breakers such as shown at 172 (FIG. 6) received within circuit breaker mounting members 52, as shown and described in U.S. Pat. No. 6,066,817, the single pole circuit breaker functions to establish an electrical path between the supply side prong 90 and the load side prong 90 of each circuit breaker mounting member 52. A series of load side wires 162 extend between the load side prong 90 of each circuit breaker mounting member 52 and the supply side prongs of switches 50, to supply power to switches 50 through circuit breaker mounting members 52 and the associated single pole circuit breakers engaged therewith. With this arrangement, the single pole circuit breakers engaged with circuit breaker mounting members 52 each provide single pole overcurrent protection for a single pole circuit interconnected with one of switches 50, in a known manner. Typically, the circuit breakers engaged with circuit breaker mounting members 52 provide single pole overcurrent protection of 15 or 20 amps.

Figure 5:
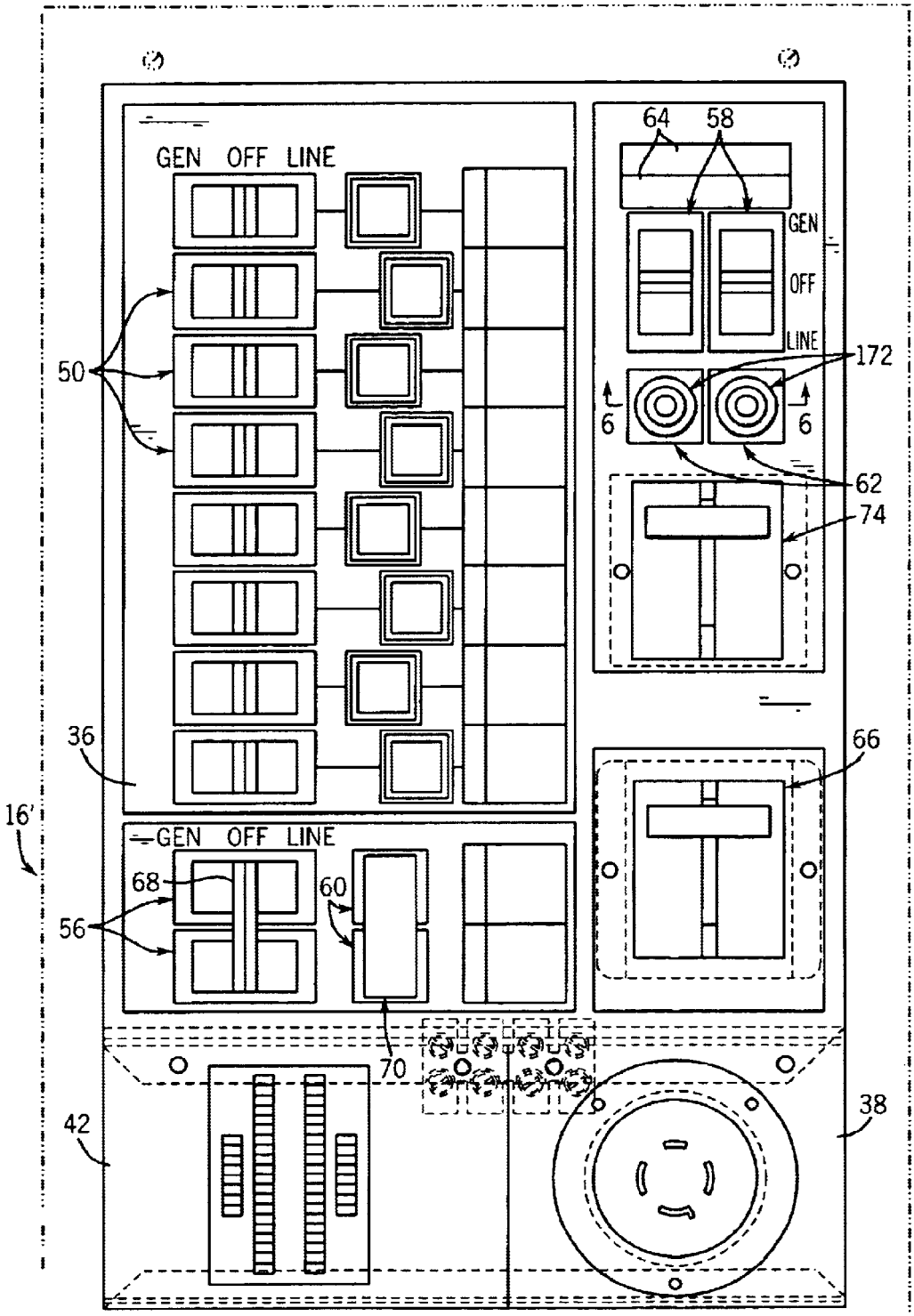
FIG. 5 is a view similar to FIG. 2, showing an alternative construction in which a pair of single pole switches are used separately and in which one of the conductor members of FIG. 2 is replaced with individual single pole circuit breakers.

FIG. 5 illustrates a modified transfer switch 16' which incorporates generally the same components as transfer switch 16, and like reference characters will be used to facilitate clarity. Transfer switch 16' differs from transfer switch 16 in that single pole circuit breakers 172 are engaged with circuit breaker mounting members 62, in place of double pole connector member 70 as in transfer switch 16. In addition, connector bar 72 is removed from connection with the switch handles of single pole switches 58, such that switches 58 are separated. This embodiment provides two (2) additional single pole circuits than transfer switch 16 with very little modification to transfer switch 16. If desired, double pole connector member 70 may be removed from circuit breaker mounting members 60 and replaced with single pole circuit breakers 172. Connector bar 68 is disengaged from the switch handles of switches 56, to provide two (2) additional single pole circuits with little modification to switch 16. In this manner, switch 16 can be converted for use in an application having two, one or no double pole circuits by selectively engaging double pole connector members 70 or single pole circuit breakers 172 with mounting members 60, 62 and selectively engaging connector bars 68, 72 with the handles of switches 56, 58 respectively.

Figure 6:
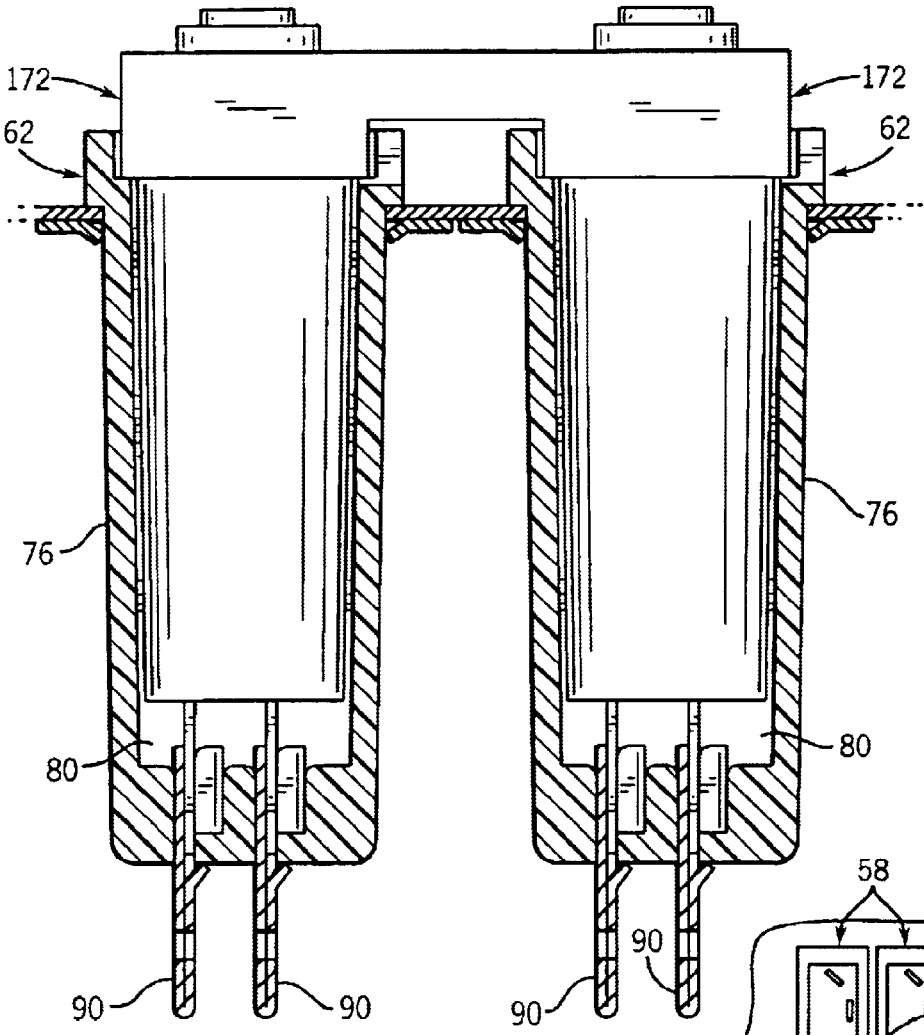
FIG. 6 is a partial section view taken along line 6—6 of FIG. 5.

FIG. 6 illustrates single pole circuit breakers 172 engaged within cavities 80 defined by circuit breaker mounting members 62. In a known manner, the prongs of circuit breakers 172 engage prongs 90 of circuit breaker mounting members 62, such that each single pole circuit breaker 172 is connected in the circuit controlled by its associated single pole switch 58. Single pole circuit breakers 172 may be such as is available from Mechanical Products of Jackson, Mich. under Model Nos. 252 or 2000, although it is understood that other satisfactory components may be used.

Figure 7:
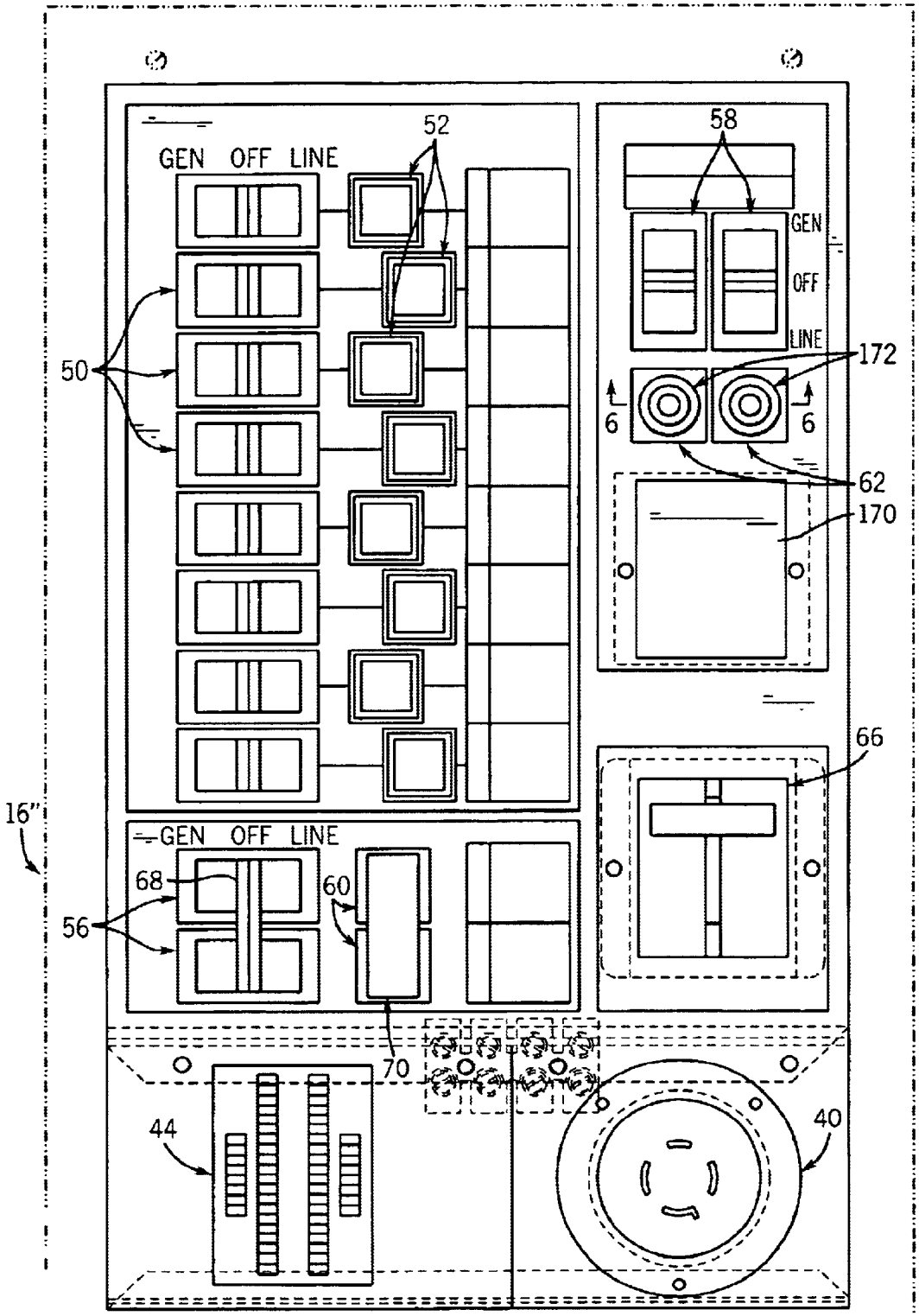
FIG. 7 is a view similar to FIGS. 2 and 5, showing an alternative construction eliminating one of the double pole circuit breakers.

FIG. 7 shows an alternative switch 16" in which double pole circuit breaker 74 is eliminated and replaced with a cover 170, which fills the opening occupied by branch double pole circuit breaker 74 in transfer switch 16. This eliminates the redundancy of branch double pole circuit breaker 74 in the embodiment of FIG. 5 to reduce the cost of switch 16".

Figure 8:
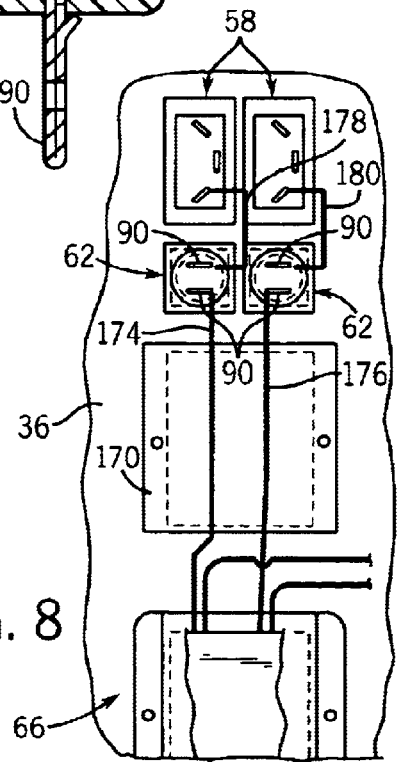
FIG. 8 is a partial rear elevation view illustrating connection of certain of the components of the transfer switch of FIG. 7.

FIG. 8 shows the modified manner in which power is supplied to switches 58 through circuit breaker mounting members 62. A pair of power supply wires 174, 176 extend from main double pole circuit breaker 66, and each is connected to the power supply side prong 90 of one of mounting members 62. Wires 178, 180 connect the opposite prongs 90 of mounting members 62 with the supply side prongs of switches 58.

With this arrangement, switches 58 are adapted to be used as either two single pole switches or one double pole switch, as desired. The same holds true for single pole switches 56, which can also be used separately in the same manner as described with respect to switches 58, either as two single pole switches or one double pole switch when tied together. As is the case with switches 58 as illustrated in FIG. 5, adaptation of switches 56 in this manner involves removing connector bar 68 and replacing double pole connector member 70 with individual single pole circuit breakers such as 172.

With the construction of transfer switch 16 of FIG. 2, overall circuit protection is provided by double pole circuit breaker 66, which is connected between power inlet input socket 40 and all of the circuits of transfer switch 16. While additional lower current circuit protection is provided by branch double pole circuit breaker 74, it is understood that branch double pole circuit breaker 74 may be eliminated and main circuit breaker 66 wired directly to power input members 62, to provide two double pole circuits having the same overcurrent limit. When the transfer switch is to be interconnected with only one double pole circuit, double pole branch circuit breaker 74 is eliminated and double pole main circuit breaker 66 having a desired overcurrent value is installed. Typically, single pole switches 56 remain tied together as shown in FIG. 2 and double pole connector member 70 remains in engagement with circuit breaker mounting members 60, as shown. Switches 58 are separated and double pole connector member 70 is removed from circuit breaker mounting members 62, as shown in FIG. 5, such that each switch 58 controls a single pole circuit with circuit protection provided by single pole circuit breakers such as 172. If there are no double pole circuits to be interconnected with the transfer switch, connector bar 68 is removed and single pole switches 56 are employed separately. Double pole connector member 70 is removed from engagement with circuit breaker mounting members 60, and is replaced with individual single pole circuit breakers such as 172. Accordingly, the illustrated embodiment is capable of providing a desired number of single pole circuits, e.g. eight or ten, although it is understood that any number of single pole circuits may be employed as desired, in combination with one or two pairs of additional single pole switches and circuit breaker mounting arrangements which can be employed in either a double pole or single pole configuration. In addition, it is possible to provide two higher amperage single pole circuits, e.g. two 20 ampere or 30 ampere circuits (depending upon the capacity of the double pole circuit breaker employed), by leaving double pole connector member 70 in place in mounting members 62 of transfer switch 16 and removing switch handle connector bar 72. In this manner, single pole switches 58 provide individual circuit transfer capability with individual circuit protection being supplied by each pole of double pole circuit breaker 74. While this results in both circuits being interrupted when one circuit is in an overload condition, this feature provides the capability of adding at least two higher amperage single pole circuits with little modification and only a very minor drawback in operation.

While the invention has been shown and described with respect to two sets of single pole switches 56, 58 and two sets of associated circuit breaker mounting members 60, 62, it is understood that either one or the other set of switches and circuit breakers may be employed individually. It is also understood that any number of branch double pole circuit breakers and associated switches and circuit breaker mounting members may be employed, and that the invention is not limited to two (2) sets of such components as shown and described.

As noted previously, circuit breaker mounting members 52 are arranged in a staggered, offset configuration. Since double pole connector member 70 is specifically design to fit into aligned circuit breaker mounting members such as 60, 62, the misalignment of circuit breaker mounting members 52 prevents double pole connector member 70 from being engaged with any of circuit breaker mounting members 52. In this manner, the installer or user cannot inadvertently override the circuit protection provided by the single pole circuit breakers adapted to be received within circuit breaker mounting members 52.

The transfer switch modifications made possible by the present invention can be made either at the time of manufacture, or at any other time prior to or subsequent to installation of the transfer switch in the field. In a manufacturing environment, the manufacturer can utilize a common face plate and other components for providing a variety of different transfer switches capable of handling a different number of single pole and double pole circuits. In the field, either before or after installation, the installer can customize the transfer switch installation according to user requirements and the specific number and type of circuits in any given installation.

Various alternatives and embodiments are contemplated as being within the scope of the following claims particularly pointing out and distinctly claiming the subject matter regarded as the invention.

I claim:

1. A transfer switch adapted for interconnection between an auxiliary power source and an electrical load center associated with a building and interconnected in a series of building electrical circuits, comprising:

a power inlet for supplying power from the auxiliary power source to the transfer switch;

a series of single pole first switches, wherein each first switch is operable to control the supply of power from the power inlet to one of a series of first single pole building electrical circuits;

a series of single pole first circuit breakers, wherein each first circuit breaker is interconnected with one of the first switches;

at least one double pole second switch operable to control the supply of power from the power inlet to a second double pole electrical circuit; and a double pole second circuit breaker interconnected with each second switch.

2. The transfer switch of claim 1, wherein the double pole second switch comprises a pair of interconnected single pole switches.

3. The transfer switch of claim 2, wherein each of the interconnected single pole switches includes a manually operable switch handle, and wherein the single pole switches are interconnected by connecting the handles together so that the handles are movable in unison.

4. The transfer switch of claim 2, further comprising a double pole main circuit breaker interconnected between the power inlet and each of the double pole second switches.

5. The transfer switch of claim 1, wherein each of a pair of the single pole first circuit breakers are removably mounted within a socket-type mounting arrangement associated with the transfer switch for electrically connecting each of the pair of single pole first circuit breakers with one of a pair of the first switches.

6. The transfer switch of claim 5, further comprising a connection arrangement for connecting together manually operable handles associated with the pair of first switches so that the pair of first switches form a double pole second switch to control the supply of power to a second double pole circuit; a double pole circuit breaker interconnected between the power inlet and the connected pair of first switches; and a connector member engaged with the socket-type mounting arrangement in place of the pair of single pole first circuit breakers for establishing an electrical path between the power inlet and the pair of interconnected first switches.

7. A transfer switch adapted for interconnection between an auxiliary power source and an electrical load center associated with a building and interconnected in a series of building electrical circuits, comprising:

a power inlet for supplying power from the auxiliary power source to the transfer switch;

a series of single pole switches interconnected with the power inlet, wherein each single pole switch is adapted for connection to a single pole building electrical circuit for controlling the supply of power thereto;

a series of single pole circuit breakers, wherein each single pole circuit breaker is interconnected with a building electrical circuit and one of the single pole switches; and a double pole main circuit breaker located downstream of the power inlet and upstream of the single pole switches.

8. The transfer switch of claim 7, further comprising a double pole switch and a double pole branch circuit breaker located downstream of the double pole main circuit breaker and interconnected with a double pole building electrical circuit.

9. The transfer switch of claim 8, wherein the double pole switch comprises a pair of single pole switches, each of which has a manually operable switch handle, and wherein the switch handles are interconnected together for movement in unison.

10. The transfer switch of claim 9, wherein the pair of single pole switches are adapted to be used separately from each other, and further comprising an interchangeable mounting arrangement electrically interconnected with each of the pair of single pole switches, wherein the interchangeable mounting arrangement is adapted to receive a pair of individual single pole circuit breakers when the pair of single pole switches are used separately from each other, for providing circuit protection in each of a pair of individual single pole building electrical circuits; and a connector member engageable with the interchangeable mounting arrangement for use when the pair of single pole switches are interconnected together, wherein the connector member includes a pair of conductors which establish an electrical path between the power inlet and the pair of single pole switches.

11. The transfer switch of claim 10, further comprising a double pole branch circuit breaker interconnected between the double pole main circuit breaker and the pair of interconnected single pole switches for providing double pole circuit protection when the pair of single pole switches are interconnected together to form a double pole switch.

12. The transfer switch of claim 10, wherein the interchangeable mounting arrangement defines a first mounting configuration compatible with the connector member, and wherein the series of single pole circuit breakers are arranged in a second configuration incompatible with the connector member for preventing engagement of the connector member with a mounting arrangement adapted to receive the series of single pole circuit breakers.

13. A transfer switch adapted for interconnection between an auxiliary power source and an electrical load center associated with a building and interconnected in a series of building electrical circuits, comprising:

a power inlet for supplying power from the auxiliary power source for inputting power to the transfer switch;

a plurality of first single pole switches, each of which is adapted for interconnection with a single pole building electrical circuit;

a plurality of single pole circuit breakers, each of which is interconnected with one of the single pole switches;

a pair of second single pole switches; and an interchangeable mounting arrangement interconnected with the second single pole switches, wherein the interchangeable mounting arrangement is adapted to individually receive a pair of single pole circuit breakers; and a connector adapted for releasable engagement with the interchangeable mounting arrangement, including a pair of conductors for establishing an electrical path between the power inlet and the pair of second single pole switches;

wherein engagement of the connector with the releasable engagement arrangement and interconnection of the pair of second single pole switches is operable to form a double pole switch adapted for interconnection with a double pole building electrical circuit, and wherein engagement of individual single pole circuit breakers with the interchangeable mounting arrangement and separation of the pair of second single pole switches is operable to form a pair of single pole switches, each of which is adapted for interconnection with a single pole building electrical circuit.

14. The transfer switch of claim 13, wherein the interchangeable mounting arrangement defines a mounting configuration which is compatible with a mounting configuration defined by the connector, and wherein the connector mounting configuration is incompatible with a mounting arrangement associated with the single pole circuit breakers, such that the connector cannot be used in place of any of the plurality of single pole circuit breakers.

15. The transfer switch of claim 13, further comprising a main double pole circuit breaker connected downstream of the power inlet.

16. The transfer switch of claim 15, further comprising a branch double pole circuit breaker located between the main double pole circuit breaker and the pair of second single pole switches when the second single pole switches are interconnected together to form a double pole switch.

17. The transfer switch of claim 13, wherein the interchangeable mounting arrangement comprises socket structure with connector structure which are electrically interconnected with the power inlet and with each of the pair of second single pole switches, wherein the socket structure defines a pair of cavities.

18. The transfer switch of claim 17, wherein each cavity is adapted to receive a single pole circuit breaker engageable with the connector structure associated with the cavity, and wherein the connector comprises a pair of interconnected members adapted to be received within the cavities, wherein each member includes a conductor engageable with the connector structure for establishing an electrical path between the power inlet and one of the pair of single pole switches.

19. A transfer switch adapted for interconnection between an auxiliary power source and an electrical load center associated with a building and interconnected in a series of building electrical circuits, comprising:

a power inlet for supplying power from the auxiliary power source;

a double pole main circuit breaker interconnected downstream of the power inlet;

a series of single pole switches and single pole circuit breakers located downstream of the double pole main breaker, wherein each single pole switch and single pole circuit breaker is interconnected with a single pole building electrical circuit; and a double pole switch and a double pole circuit breaker located downstream of the main circuit breaker, wherein the double pole switch and the double pole circuit breaker are adapted for interconnection with a double pole building electrical circuit.

20. The transfer switch of claim 19, wherein the double pole switch comprises a pair of single pole switches interconnected together.

21. The transfer switch of claim 20, wherein each of the pair of single pole switches includes a manually operable movable switch handle, wherein the switch handles are interconnected together by means of a connector which connects the switch handles together for movement in unison.

22. The transfer switch of claim 20, wherein the double pole circuit breaker is removable such that the pair of single pole switches are connectable directly to the double pole main circuit breaker, and further comprising a single pole circuit breaker located between the double pole main circuit breaker and each of the pair of single pole switches.

23. The transfer switch of claim 22, wherein the pair of single pole circuit breakers are releasably engaged with a socket-type mounting arrangement which includes a socket electrically interconnected with each of the pair of single pole switches, and further comprising a connector which is engaged with the socket-type mounting arrangement when the double pole circuit breaker is positioned between the double pole switch and the double pole main circuit breaker, wherein the connector includes a pair of separate electrical conductors which cooperate with the socket-type mounting arrangement for establishing an electrical path between the double pole switch and the double pole circuit breaker.

24. A method of constructing a multi-circuit transfer switch adapted for interconnection between an auxiliary power source and an electrical load center associated with a building, comprising the steps of:

providing a transfer switch housing with a series of circuit connections, each of which includes a power supply selection switch; and interconnecting either a first double pole type circuit breaker with a pair of the power supply selection switches, or a single pole type circuit breaker with each of the pair of power supply selection switches;

further including, when the double pole type circuit breaker is interconnected with the pair of switches, the step of connecting together manually operated switch handles associated with the pair of power supply selection switches.

25. The method of claim 24, further comprising the step of providing the transfer switch housing with a power inlet and connecting a main double pole type circuit breaker downstream of the power inlet.

26. The method of claim 24, further comprising the step of interconnecting a mounting member having releasable engagement structure between the pair of power supply selection switches and the power inlet.

27. The method of claim 26, wherein the step of interconnecting a single pole type circuit breaker with each of the pair of power supply selection switches is carried out by engaging a pair of individual single pole circuit breakers with the mounting member, and wherein the step of interconnecting the first double pole type circuit breaker with the pair of power supply selection switches is carried out by electrically connecting the double pole type circuit breaker to the mounting member and engaging a dual conductor member with the mounting member, wherein the dual conductor member includes a pair of separate conductors which establish an electrical path between the first double pole type circuit breaker and the interconnected pair of switches.

28. The method of claim 27, wherein the mounting member is in the form of a socket-type member, and wherein each of the power supply selection switches is interconnected with the socket-type mounting member, and wherein the dual conductor member has a configuration which matches the configuration of a pair of socket-type mounting members interconnected with the pair of power supply selection switches, and wherein the configuration of the dual conductor member is incompatible with the remaining mounting members so as to prevent the conductor member from being engaged with any mounting members other than the mounting members interconnected with the pair of switches.

* * * * *